US005692980A

United States Patent [19]

Trotman

[11] Patent Number: 5,692,980

[45] Date of Patent: Dec. 2, 1997

[54] KICK BAG GAME AND APPARATUS KIT

[76] Inventor: Stephenson E. Trotman, 4165 Fieldgate Dr #54, Mississauga, Ontario, Canada, L4W 2M9

[21] Appl. No.: 736,127

[22] Filed: Oct. 24, 1996

[51] Int. Cl.[6] ..... A63B 67/00

[52] U.S. Cl. ..... 473/473; 473/492

[58] Field of Search ..... 473/459, 465, 473/473, 474, 490, 492, 494

[56] References Cited

U.S. PATENT DOCUMENTS

| | | | |
|---|---|---|---|
| D. 313,639 | 1/1991 | Cobb | D21/203 |
| 3,399,889 | 9/1968 | Harry | 273/411 |
| 4,151,994 | 5/1979 | Stalberger, Jr. | 473/594 |
| 4,284,277 | 8/1981 | Leonard et al. | 273/411 |
| 4,616,834 | 10/1986 | Davis | 273/411 |
| 4,732,395 | 3/1988 | Halverson | 473/492 |
| 5,014,990 | 5/1991 | Kaser et al. | 273/128 R |
| 5,290,043 | 3/1994 | Vidinic | 273/411 |
| 5,346,228 | 9/1994 | Offutt | 273/402 |

OTHER PUBLICATIONS

The Hacky-Sack Book, by John Cassidy, Klutz Press ©1982 Title Page, Copyright Page, pp. 12–13 473–For. 212.

Foot Bag World, vol. 12, No. 2 Before Jan. 1996 pp. 3, 6, 7 and 46 473–For. 212.

*Primary Examiner*—William H. Grieb

[57] ABSTRACT

A new Kick Bag Game and Apparatus Kit for playing a footbag game between opposing teams divided into two zones by a medially positioned portable reticulated net, wherein the players must kick the footbag back and forth over the net to score points. The inventive device includes a court boundary marker which displays the court, a portable reticulated net positioned across the center of the court supported vertically by a first and second support poles in a position to one another, and a footbag which is kicked back and forth over the portable reticulated net.

10 Claims, 3 Drawing Sheets

FIG 3
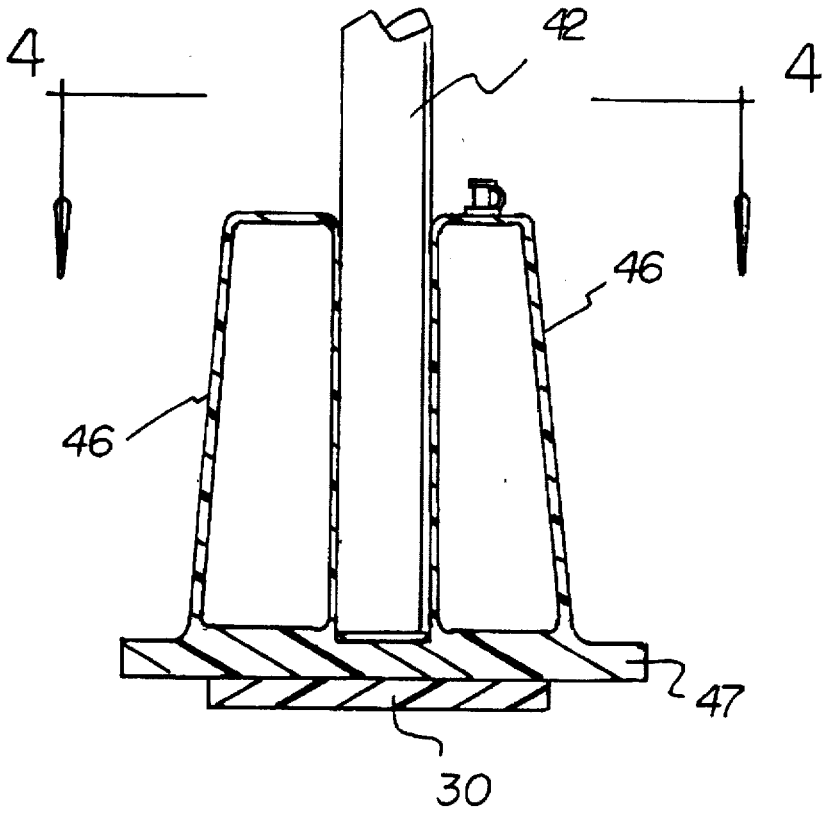
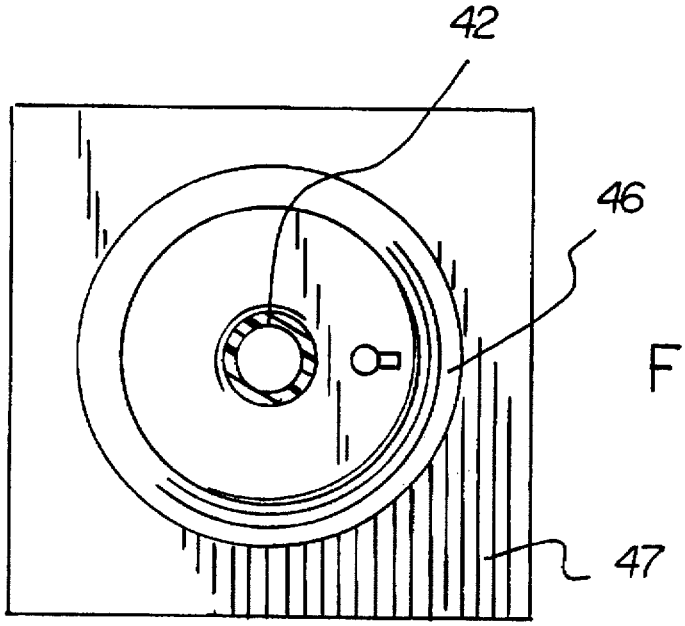
FIG 4

KICK BAG GAME AND APPARATUS KIT

BACKGROUND OF THE INVENTION

1. Field of the Invention

The present invention relates to Game Devices and more particularly pertains to a new Kick Bag Game and Apparatus Kit for playing a footbag game between opposing teams divided into two zones by a mesially positioned portable reticulated net, wherein the players must kick the footbag back and forth over the net to score points.

2. Description of the Prior Art

The use of Game Devices is known in the prior art. More specifically, Game Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Game Devices include U.S. Pat. No. 5,346,228; U.S. Pat. No. 5,290,043; U.S. Pat. No. 4,284,277; U.S. Pat. No. 5,014,990; U.S. Pat. No. 4,616,834 and U.S. Pat. No. Des. 313,639.

While these devices fulfill their respective, particular objectives and requirements, the aforementioned patents do not disclose a new Kick Bag Game and Apparatus Kit. The inventive device includes a court boundary marker which displays the court, a portable reticulated net positioned across the center of the court supported vertically by a first and second support poles in a position to one another, and a footbag which is kicked back and fourth over the portable reticulated net.

In these respects, the Kick Bag Game and Apparatus Kit according to the present invention substantially departs from the conventional concepts and designs of the prior art, and in so doing provides an apparatus primarily developed for the purpose of playing a footbag game between opposing teams divided into two zones by a mesially positioned portable reticulated net, wherein the players must kick the footbag back and forth over the net to score points.

SUMMARY OF THE INVENTION

In view of the foregoing disadvantages inherent in the known types of Game Devices now present in the prior art, the present invention provides a new Kick Bag Game and Apparatus Kit construction wherein the same can be utilized for playing a footbag game between opposing teams divided into two zones by a mesially positioned portable reticulated net, wherein the players must kick the footbag back and forth over the net to score points.

The general purpose of the present invention, which will be described subsequently in greater detail, is to provide a new Kick Bag Game and Apparatus Kit apparatus and method which has many of the advantages of the Game Devices mentioned heretofore and many novel features that result in a new Kick Bag Game and Apparatus Kit which is not anticipated, rendered obvious, suggested, or even implied by any of the prior art Game Devices, either alone or in any combination thereof.

To attain this, the present invention generally comprises a court boundary marker which displays the court, a portable reticulated net positioned across the center of the court supported vertically by a first and second support poles in a position to one another, and a footbag which is kicked back and forth over the portable reticulated net.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Kick Bag Game and Apparatus Kit apparatus and method which has many of the advantages of the Game Devices mentioned heretofore and many novel features that result in a new Kick Bag Game and Apparatus Kit which is not anticipated, rendered obvious, suggested, or even implied by any of the prior art Game Devices, either alone or in any combination thereof.

It is another object of the present invention to provide a new Kick Bag Game and Apparatus Kit which may be easily and efficiently manufactured and marketed.

It is a further object of the present invention to provide a new Kick Bag Game and Apparatus Kit which is of a durable and reliable construction.

An even further object of the present invention is to provide a new Kick Bag Game and Apparatus Kit which is susceptible of a low cost of manufacture with regard to both materials and labor, and which accordingly is then susceptible of low prices of sale to the consuming public, thereby making such Kick Bag Game and Apparatus Kit economically available to the buying public.

Still yet another object of the present invention is to provide a new Kick Bag Game and Apparatus Kit which provides in the apparatuses and methods of the prior art some of the advantages thereof, while simultaneously overcoming some of the disadvantages normally associated therewith.

Still another object of the present invention is to provide a new Kick Bag Game and Apparatus Kit for playing a footbag game between opposing teams divided into two zones by a mesially positioned portable reticulated net, wherein the players must kick the footbag back and forth over the net to score points.

Yet another object of the present invention is to provide a new Kick Bag Game and Apparatus Kit which includes a court boundary marker which displays the court, a portable reticulated net positioned across the center of the court supported vertically by a first and second support poles in a position to one another, and a footbag which is kicked back and fourth over the portable reticulated net.

Still yet another object of the present invention is to provide a new Kick Bag Game and Apparatus Kit that incorporates soccer, volleyball and tennis into a team sport or a one-on-one competition.

Even still another object of the present invention is to provide a new Kick Bag Game and Apparatus Kit that two to eight players can play thereby improving their coordination and physical fitness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a top view of the first support pole.

DESCRIPTION OF THE PREFERRED EMBODIMENT

Figure 1:
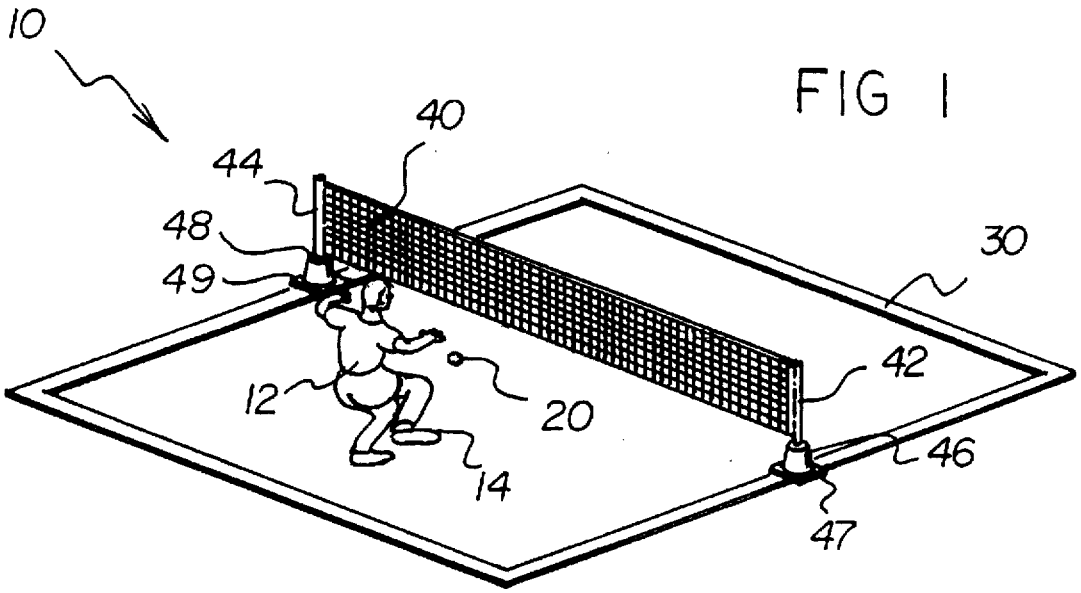
FIG. 1 is an upper perspective view of a new Kick Bag Game and Apparatus Kit according to the present invention.

With reference now to the drawings, and in particular to FIGS. 1 through 6 thereof, a new Kick Bag Game and Apparatus Kit embodying the principles and concepts of the present invention and generally designated by the reference numeral 10 will be described.

More specifically, it will be noted that the Kick Bag Game and Apparatus Kit 10 comprises a court boundary marker 30 displaying a rectangular playing court, a portable reticulated net 40 formed in an elongated rectangular shape positioned at the elongated center aligned vertically thereby dividing the playing court into two team zones, and a footbag 20 which is kicked by a player 12 with his side of foot 14 over the portable reticulated net 40.

Figure 2:
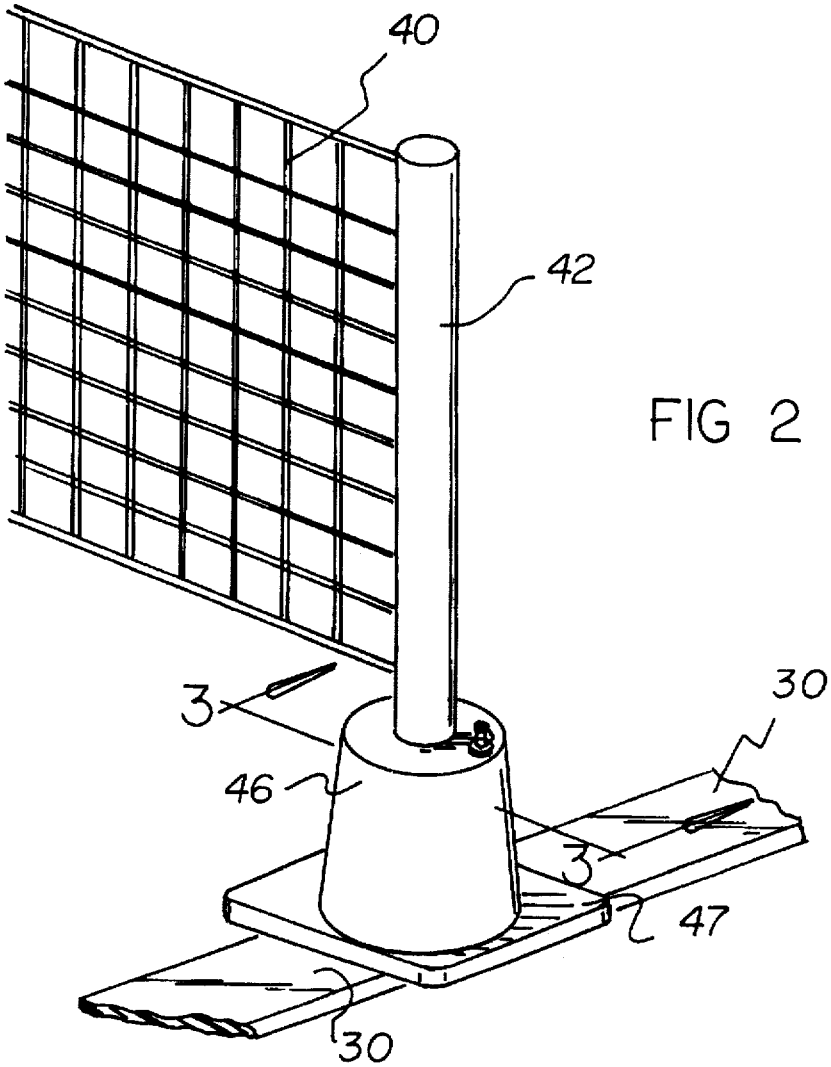
FIG. 2 is a perspective view of the portable reticulated net supported by the first support pole.

As best illustrated in FIGS. 1 through 4, it can be shown that a first support pole 42 engages one end of the portable reticulated net 40. A second support pole 44 engages the end of the portable reticulated net 40 opposite of the first support pole 42, thereby tensioning and supporting the portable reticulated net 40. The first support pole 42 includes a first inflatable base 46 at the end opposite of the portable reticulated net 40 as best shown in FIGS. 2–4 of the drawings. The first inflatable base 46 is conical shaped with a central passage which receives the first support pole 42 in a vertical position. The second support pole 44 includes a second inflatable base 48 at the end opposite of the portable reticulated net 40. The second inflatable base 48 is conical shaped with a central passage which receives the second support pole 44 in a vertical position. The first inflatable base 46 includes a first base 47 secured horizontally to the bottom surface to provide increased weight for support as shown in FIGS. 2–4 of the drawings. The opposite side of first base 47 is juxtaposed to one side of the court boundary marker 30. The second inflatable base 48 has a second base 49 secured horizontally to the bottom surface to provide increased weight for support. The opposite side of second base 49 is juxtaposed to the side of the court boundary marker 30 opposite of the first base 47. The portable reticulated net 40 is constructed so as to prevent passage of the footbag 20. The footbag 20 has a two and a half inch diameter.

Figure 5:
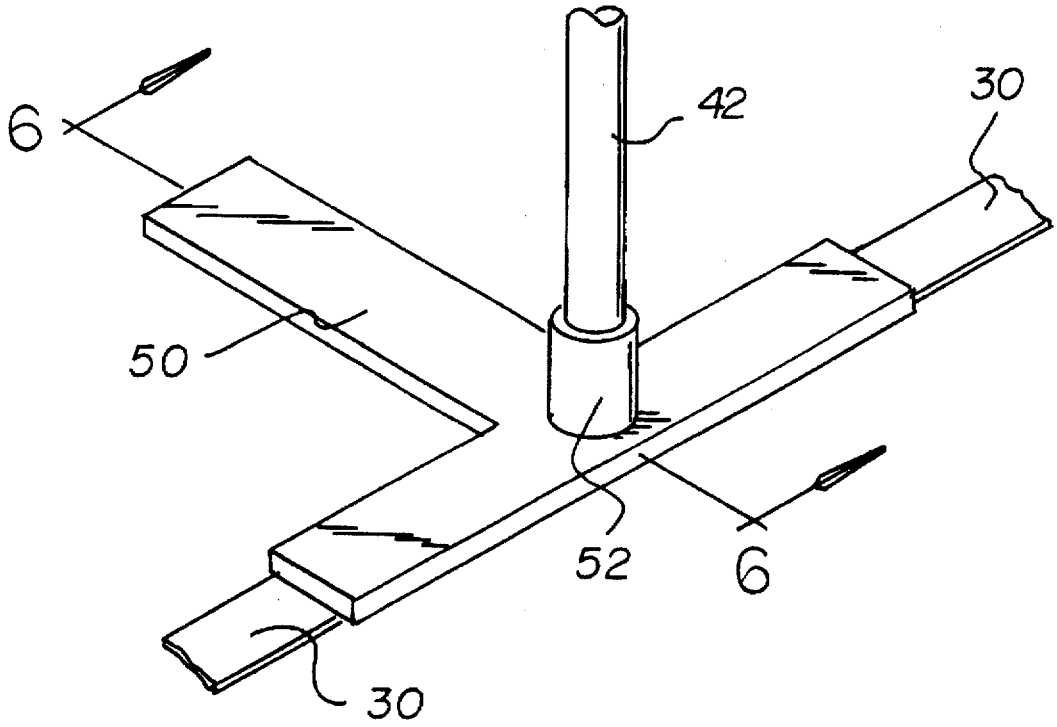
FIG. 5 is an alternative embodiment of a T-shaped base.
Figure 6:
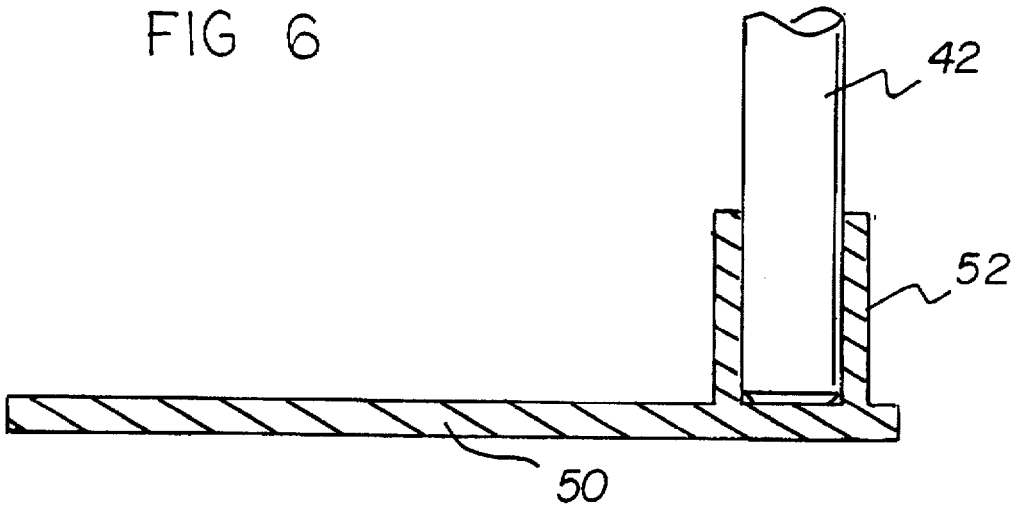
FIG. 6 is a cross sectional view taken along line 6—6 of FIG. 5.

In an alternative embodiment as shown in FIGS. 5 and 6 of the drawing, a T-shaped base 50 includes a pole support tube 52 secured orthogonally. The pole support tube 52 receives the end of the first support pole 42 opposite of the portable reticulated net 40 thereby supporting said portable reticulated net 40 vertically as best shown in FIG. 5 of the drawings. Another pole support tube 52 secured to another T-shaped base 50 receives the end of the second support pole 44 opposite of the portable reticulated net 40 thereby supporting said portable reticulated net 40 vertically. The portable reticulated net 40 is preferably constructed so as to prevent passage of the footbag 20. The footbag 20 preferably has a two and a half inch diameter.

Basic Rules of the Game

The basic rules of the game are as set forth below. Those experienced in formal league play will realize the necessity for a more comprehensive set of rules and these have been developed by the inventor. However, the following are considered sufficient for most purposes of organized or semi-organized play.

Sets and Serves

Official games will consist of four sets, with each set comprising five serves. To determine which team serves first, the footbag is kicked back and forth until one team scores a point which they retain. The team that scored the point is the team that serves the first set. After that, rotation of the teams serving after each set determines who serves the next set.

Composition of Teams

A team can be composed of as few as one person and as many as four, as long as the two teams have the same number of players. The two teams are positioned in a position to one another about the portable reticulated net. The players may take any position on the playing court as they wish.

Allowed Body Contact With Footbag

A player may hit the footbag over the net only with the foot. However, a player may contact the footbag with his head to pass to a fellow teammate, but not to hit over the net.

Number of Times a Single Player May Contact the Footbag

A player may contact the footbag with the their feet or head only three times, where after they must either pass to a teammate or kick the ball over the net.

Computation of Score

The team that scored the first point in determining which team served first retains the point they scored. Thereafter, a point is scored for a team when the other team does not return a serve or kick over the net. A point is scored for a team when the other team allows the footbag to make contact with the ground. A point is scored for a team when the other team touches the footbag with their hand. A point is scored for a team when the other team hits the ball over the net with their head. A point is scored if the other team's player hits the footbag more than three times. A point is scored if the footbag is hit outside of the court boundary marker.

Result When Footbag Touches the Net on Serve

If the footbag makes contact with the net on a serve, if the footbag lands on the opponent's side then the team is allowed to reserve the footbag. However, if the footbag lands on the server's side of the court then the opposing team receives a point.

Determination of Winning Team

The first team to reach 21 points wins the game. However, if there happens to be a tie, then the first team to score an additional two points wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Kick Bag Game and Apparatus Kit comprising:

a court boundary marker displaying a rectangular playing court;

a portable reticulated net formed in an elongated rectangular shape positioned at the elongated center aligned vertically thereby dividing the playing court into two team zones;

a footbag which is kicked by a player with his side of foot over the portable reticulated net;

a first support pole engages one end of the portable reticulated net;

a second support pole engages the end of the portable reticulated net opposite of the first support pole, thereby tensioning and supporting the portable reticulated net;

the first support pole includes a first inflatable base at the end opposite of the portable reticulated net, wherein the first inflatable base is conical shaped with a central passage which receives the first support pole in a vertical position; and the second support pole includes a second inflatable base at the end opposite of the portable reticulated net, wherein the second inflatable base is conical shaped with a central passage which receives the second support pole in a vertical position.

2. The Kick Bag Game and Apparatus Kit of claim 1, wherein the first inflatable base includes a first base secured horizontally to the bottom surface to provide increased weight for support, where the opposite side of first base is juxtaposed to one side of the court boundary marker.

3. The Kick Bag Game and Apparatus Kit of claim 2, wherein the second inflatable base includes a second base secured horizontally to the bottom surface to provide increased weight for support, where the opposite side of second base is juxtaposed to the side of the court boundary marker opposite of the first base.

4. The Kick Bag Game and Apparatus Kit of claim 3, wherein the portable reticulated net is constructed so as to prevent passage of the footbag.

5. The Kick Bag Game and Apparatus Kit of claim 4, wherein the footbag has a two and a half inch diameter.

6. The Kick Bag Game and Apparatus Kit of claim 1, wherein a T-shaped base includes a pole support tube secured orthogonally.

7. The Kick Bag Game and Apparatus Kit of claim 6, wherein the pole support tube receives the end of the first support pole opposite of the portable reticulated net thereby supporting said portable reticulated net vertically.

8. The Kick Bag Game and Apparatus Kit of claim 7, wherein another pole support lube receives the end of the second support pole opposite of the portable reticulated net thereby supporting said portable reticulated net vertically.

9. The Kick Bag Game and Apparatus Kit of claim 8, wherein the portable reticulated net is constructed so as to prevent passage of the footbag.

10. The Kick Bag Game and Apparatus Kit of claim 9, wherein the footbag has a two and a half inch diameter.

* * * * *